US010253790B2

(12) United States Patent
Zhou et al.

(10) Patent No.: US 10,253,790 B2
(45) Date of Patent: Apr. 9, 2019

(54) FORKLIFT, HYDRAULIC CYLINDER ASSEMBLY AND HYDRAULIC DEVICE THEREOF

(71) Applicant: BYD COMPANY LIMITED, Shenzhen, Guangdong (CN)

(72) Inventors: Lei Zhou, Guangdong (CN); Qiang Guo, Guangdong (CN)

(73) Assignee: BYD Company Limited, Shenzhen, Guangdong (CN)

( * ) Notice: Subject to any disclaimer, the term of this patent is extended or adjusted under 35 U.S.C. 154(b) by 235 days.

(21) Appl. No.: 15/146,691

(22) Filed: May 4, 2016

(65) Prior Publication Data

US 2016/0245313 A1 Aug. 25, 2016

Related U.S. Application Data

(63) Continuation of application No. PCT/CN2014/092201, filed on Nov. 25, 2014.

(30) Foreign Application Priority Data

Nov. 29, 2013 (CN) ..... 2013 1 0629274

(51) Int. Cl.
*F01L 17/02* (2006.01)
*F15B 15/14* (2006.01)
(Continued)

(52) U.S. Cl.
CPC ..... *F15B 15/149* (2013.01); *B66F 9/22* (2013.01); *F15B 11/15* (2013.01); *F15B 2211/7725* (2013.01)

(58) Field of Classification Search
CPC .... F15B 2211/7725; F01L 17/00; F01L 17/02
See application file for complete search history.

(56) References Cited

U.S. PATENT DOCUMENTS 827,107 A * 7/1906 Maynard ..... F01L 23/00 91/328
1,056,736 A * 3/1913 Carey ..... F01L 23/00 91/330

(Continued)

FOREIGN PATENT DOCUMENTS

CN 2270839 Y 12/1997
CN 202326505 U 7/2012

OTHER PUBLICATIONS

BYD Company Limited, International Search Report and Written Opinion, PCT/CN2014/092201, dated Feb. 27, 2015, 11 pgs.

*Primary Examiner* — F Daniel Lopez
(74) *Attorney, Agent, or Firm* — Sheppard, Mullin, Richter & Hampton LLP

(57) ABSTRACT

A forklift, a hydraulic cylinder assembly (100) and a hydraulic device thereof are provided. The hydraulic cylinder assembly (100) includes a cylinder (1) having first, second oil inlets (151, 152) and first, second oil outlets (153, 154) therein; a cylinder liner (2) disposed within the cylinder (1) and being moveable between first and second positions, and defining a first oil port (21) and a second oil port (22) therein; a piston (31) disposed within the cylinder liner (2) and being moveable between a third position and a fourth position; a first oil chamber (41) and a second oil chamber (42) are defined by the cylinder (1), the cylinder liner (2) and the piston (31), the first oil chamber (41) is communicated with the first oil port (21), and the second oil chamber (42) is communicated with the second oil port (22).

9 Claims, 5 Drawing Sheets

(51) Int. Cl.
*F15B 11/15* (2006.01)
*B66F 9/22* (2006.01)

(56) References Cited

U.S. PATENT DOCUMENTS

| | | | | |
|---|---|---|---|---|
| 1,418,079 | A * | 5/1922 | Huff | F01L 15/12<br>91/276 |
| 5,577,433 | A | 11/1996 | Henry | |
| 2006/0169132 | A1 | 8/2006 | Tucker | |

* cited by examiner

FORKLIFT, HYDRAULIC CYLINDER ASSEMBLY AND HYDRAULIC DEVICE THEREOF

CROSS REFERENCE TO RELATED APPLICATION

This application is a continuation application of PCT Patent Application No. PCT/CN2014/092201, entitled "FORKLIFT, HYDRAULIC CYLINDER ASSEMBLY AND HYDRAULIC DEVICE THEREOF" filed on Nov. 25, 2014, which claims priority and benefits of Chinese Patent Application No. 201310629274.2, filed with State Intellectual Property Office on Nov. 29, 2013, the entire contents of the above-identified applications are incorporated herein by reference in their entirety.

TECHNICAL FIELD

Embodiments of the present disclosure generally relate to a forklift, a hydraulic cylinder assembly and a hydraulic device thereof.

BACKGROUND

A straight line reciprocating motion mechanism is wildly used in a modern mechanical field, such as a feeding mechanism of an automatic cutting machine and an automatic feeding mechanism, etc. However, the straight line reciprocating motion mechanism with a mechanical transmission is unavoidably subjected to a large inertial impact when a motion direction is changed, which reduces a service life of the straight line reciprocating motion mechanism and generates ambient noise.

SUMMARY

Embodiments of the present disclosure seek to solve at least one of the problems existing in the related art to at least some extent.

A first object of the present disclosure is to provide a hydraulic cylinder assembly for providing a straight line reciprocating motion, with a lower noise and a longer service life.

A second object of the present disclosure is to provide a hydraulic device having the hydraulic cylinder assembly.

A third object of the present disclosure is to provide a forklift having the hydraulic cylinder assembly.

Embodiments of a first aspect of the present disclosure provide a hydraulic cylinder assembly, which includes a cylinder defining a first oil inlet, a second oil inlet, a first oil outlet and a second oil outlet therein; a cylinder liner disposed within the cylinder and being moveable between a first position and a second position, and defining a first oil port and a second oil port therein; a piston disposed within the cylinder liner and being moveable between a third position and a fourth position; and a piston rod connected to at least one of two end faces of the piston and defining a free end extending out of the cylinder, wherein a first oil chamber and a second oil chamber are defined by the cylinder, the cylinder liner and the piston and located at two sides of the piston respectively, the first oil chamber is communicated with the first oil port, and the second oil chamber is communicated with the second oil port, wherein when the cylinder liner is located at the first position, a communication between the first oil inlet and the first oil port is formed, a communication between the second oil inlet and the second oil port is interrupted, a communication between the first oil chamber and the first oil outlet is interrupted, and a communication between the second oil chamber and the second oil outlet is formed, wherein when the cylinder liner is located at the second position, the communication between the first oil inlet and the first oil port is interrupted, the communication between the second oil inlet and the second oil port is formed, the communication between the first oil chamber and the first oil outlet is formed, and the communication between the second oil chamber and the second oil outlet is interrupted.

With the hydraulic cylinder assembly according to an embodiment of the present disclosure, since the piston rod is connected to a moving part to drive the moving part to move in a manner of the straight line reciprocating motion, when the hydraulic cylinder assembly changes the moving direction of the moving part, an inertial impact of the cylinder liner against the cylinder can be reduced greatly, thus prolonging the service life of the hydraulic cylinder assembly and reducing the working noise of the hydraulic cylinder assembly.

In some embodiments, a sliding resistance between the piston and the cylinder liner is less than that between the cylinder liner and the cylinder.

In some embodiments, a first oil groove and a second oil groove are formed in the cylinder liner, the first oil groove is communicated with the first oil port and the first oil chamber respectively, and the second oil groove is communicated with the second oil port and the second oil chamber respectively.

In some embodiments, the hydraulic cylinder assembly further includes a first seal ring, wherein a liner groove is formed in an outer peripheral surface of the cylinder liner and configured to receive the first seal ring therein.

In some embodiments, a plurality of the liner grooves are provided and spaced apart from one another in a length direction of the cylinder liner, a plurality of the first seal rings are provided and fitted into the liner grooves in a manner of one-to-one correspondence.

In some embodiments, the hydraulic cylinder assembly further includes a second seal ring, wherein a piston groove is formed in an outer peripheral surface of the piston and configured to receive the second seal ring therein.

In some embodiments, two piston rods are connected to the two end faces of the piston respectively, the cylinder includes: a cylinder body; a first guide member and a second guide member disposed at two ends of the cylinder body respectively, wherein the free end of each piston rod extends out of the cylinder through a corresponding one of the first and second guide members.

In some embodiments, the cylinder further includes a first end cover and a second end cover disposed at the two ends of the cylinder body and covering the first and second guide members respectively.

In some embodiments, the hydraulic cylinder assembly further includes a third seal ring, wherein a cover groove is formed in each of the first and second end covers, wherein the third seal ring is disposed in the cover groove and fitted over an outer peripheral surface of the piston rod.

Embodiments of a second aspect of the present disclosure provide a hydraulic device. the hydraulic device includes: the hydraulic cylinder assembly according to embodiments of the first aspect of the present disclosure and an oil pump communicated with the first oil inlet and the second oil inlet to supply hydraulic oil to the first and second oil inlets respectively.

In some embodiments, one oil pump is provided.

In some embodiments, the oil pump comprises a first sub-oil pump communicated with the first oil inlet to supply hydraulic oil to the first oil inlet and a second sub-oil pump communicated with the second oil inlet to supply hydraulic oil to the second oil inlet.

Embodiments of a third aspect of the present disclosure provide a forklift. The forklift includes the hydraulic device according to embodiments of the second aspect of the present disclosure.

The above summary of the present disclosure is not intended to describe each disclosed embodiment or every implementation of the present disclosure. The Figures and the detailed description which follow more particularly exemplify illustrative embodiments.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
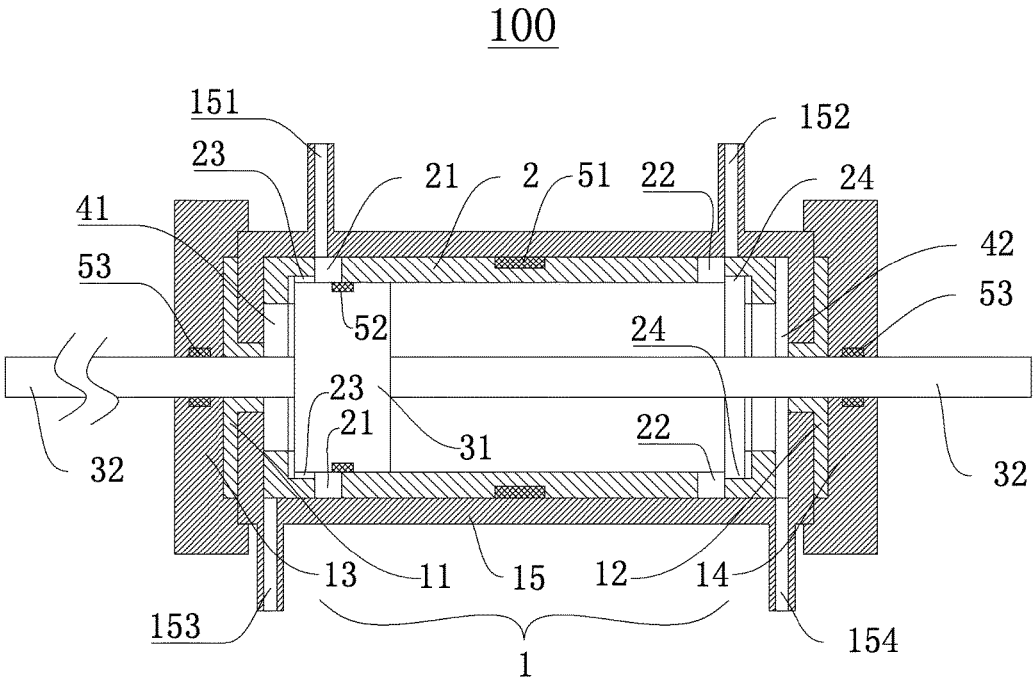
FIG. 1 is a sectional view of a hydraulic cylinder assembly according to an embodiment of the present disclosure.

In order to make the problem to be solved, the technical proposal and the beneficial effects of the present disclosure move transparent, detailed descriptions of the present disclosure will be made combined with attached drawings and embodiments. It should be understood that specific embodiments described herein are just used to illustrate the present disclosure, and not to limit the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "longitudinal", "lateral", "front", "rear", "right", "left", "inner", "outer", "lower", "upper", "horizontal", "vertical", "above", "below", "up", "top", "bottom", "inner", "outer", "clockwise", "anticlockwise" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance.

In the description of the present disclosure, unless specified or limited otherwise, it should be noted that, terms "mounted," "connected" "coupled" and "fastened" may be understood broadly, such as permanent connection or detachable connection, electronic connection or mechanical connection, direct connection or indirect connection via intermediary, inner communication or interaction between two elements. These having ordinary skills in the art should understand the specific meanings in the present disclosure according to specific situations.

The present disclosure will be further described with reference to the drawings and embodiments.

A hydraulic cylinder assembly 100 according to an embodiment of the present disclosure is adapted to provide a straight line reciprocating motion for mechanical and hydraulic transmissions.

As shown in FIGS. 1-5, the hydraulic cylinder assembly 100 includes a cylinder 1, a cylinder liner 2 and a piston 31.

Specifically, the cylinder 1 has a first oil inlet 151, a second oil inlet 152, a first oil outlet 153 and a second oil outlet 154 therein. A section of the cylinder 1 in a length direction, i.e. an axial direction, of the cylinder 1 may be configured as a rectangle, and the first and second oil inlets 151, 152 may be formed at one side, such as an upper side in the drawings of the cylinder 1, the first and second oil outlets 153, 154 may be formed at the other side, such as a lower side in the drawings of the cylinder 1. An interior of the cylinder 1 is hollow and communicated with the first oil inlet 151, the second oil inlet 152, the first oil outlet 153 and the second oil outlet 154 respectively.

Figure 2:
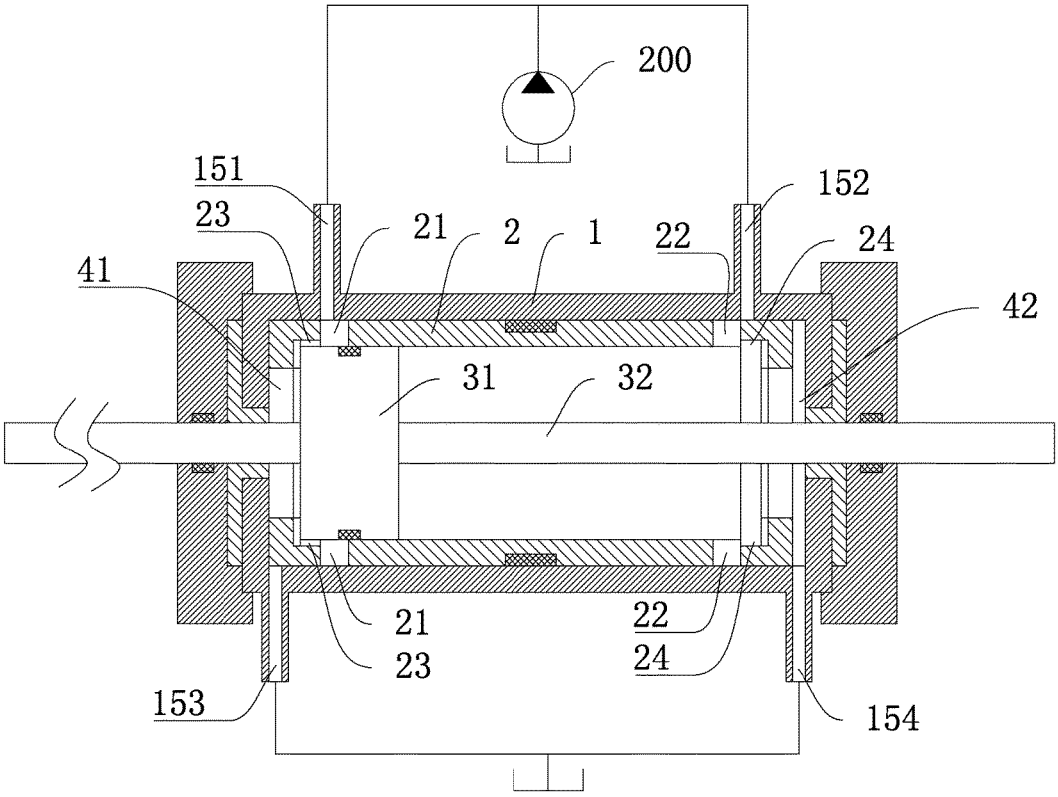
FIG. 2 is a sectional view of a hydraulic device according to an embodiment of the present disclosure, in which a cylinder liner and a piston of a hydraulic cylinder assembly are located at a first position and a third position respectively.
Figure 3:
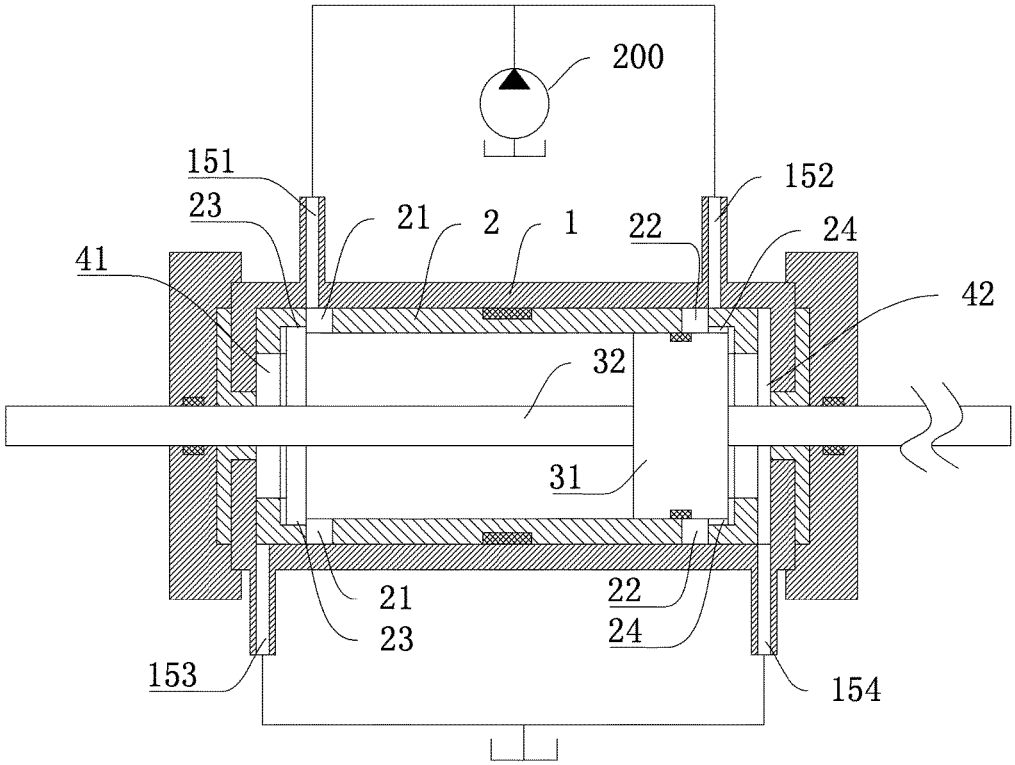
FIG. 3 is a sectional view of a hydraulic device according to an embodiment of the present disclosure, in which a cylinder liner and a piston of a hydraulic cylinder assembly are located at a first position and a fourth position respectively.
Figure 4:
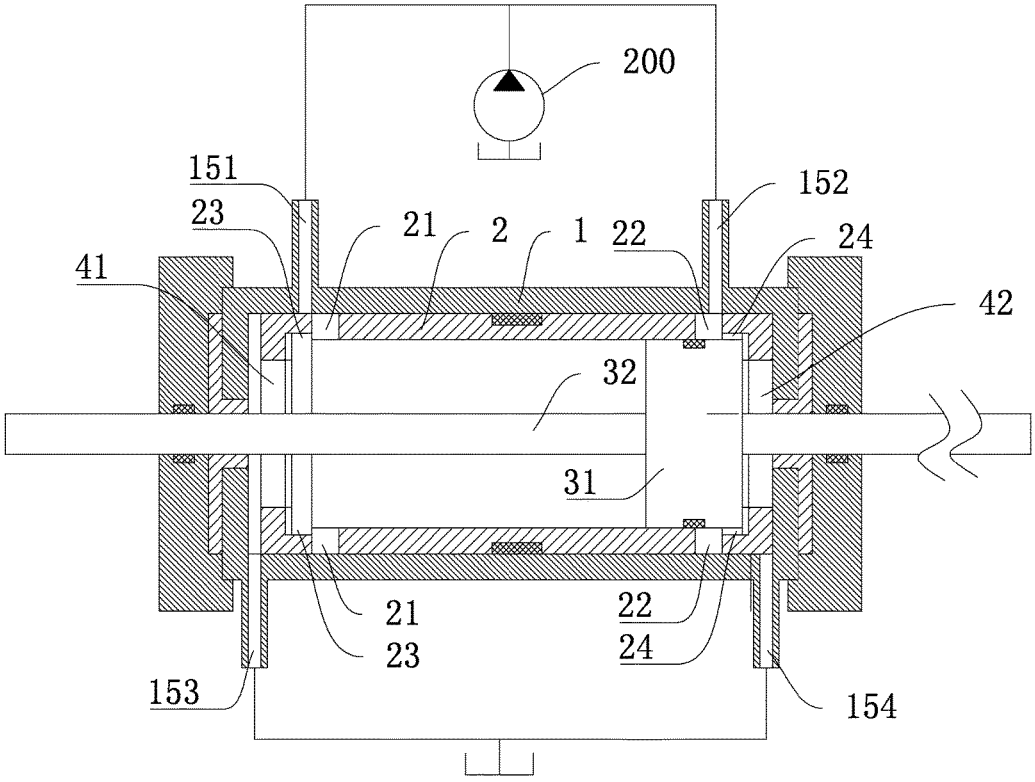
FIG. 4 is a sectional view of a hydraulic device according to an embodiment of the present disclosure, in which a cylinder liner and a piston of a hydraulic cylinder assembly are located at a second position and a fourth position respectively.
Figure 5:
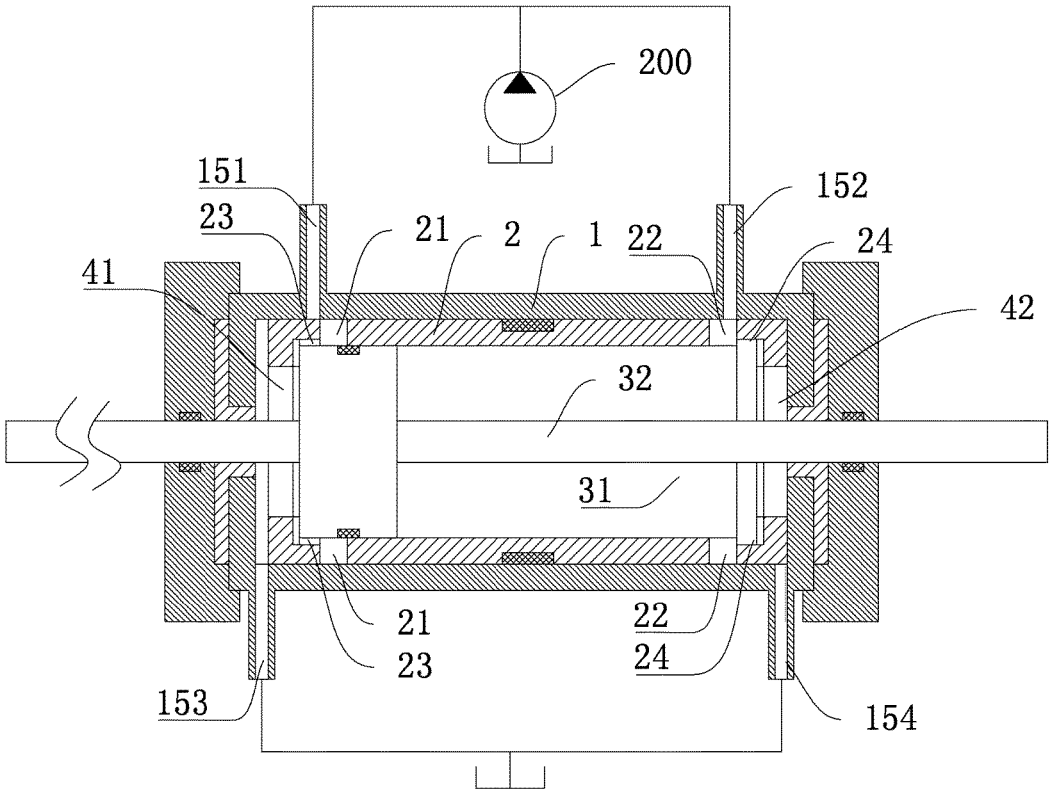
FIG. 5 is a sectional view of a hydraulic device according to an embodiment of the present disclosure, in which a cylinder liner and a piston of a hydraulic cylinder assembly are located at a second position and a third position respectively.

The cylinder liner 2 is disposed within the cylinder 1 and moveable between a first position and a second position, in other words, within the cylinder 1, the cylinder liner 2 can be moved between the first and second positions relative to the cylinder 1. As shown in FIGS. 1-3, the cylinder liner 2 is located at the first position relative to the cylinder 1; correspondingly, as shown in FIGS. 4-5, the cylinder liner 2 is located at the second position relative to the cylinder 1.

The cylinder liner 1 has a first oil port 21 and a second oil port 22 therein. A section of the cylinder liner 2 in the length direction of the cylinder 1 may be configured as a rectangle as well. An interior of the cylinder liner 2 is hollow and communicated with the first and second oil ports 21, 22 respectively. A seal structure may be formed between an outer wall of the cylinder liner 2 and an inner wall of the cylinder 1 after an assembling of the cylinder liner 2 and cylinder 1 being finished, or a first seal ring 51, which will be described hereinafter, may be configured as a seal structure between the cylinder liner 2 and cylinder 1.

The piston 31 is disposed within the cylinder liner 1 and moveable between a third position and a fourth position, in other words, within the cylinder liner 2, the piston 31 can be moved between the third and fourth positions relative to the cylinder liner 2. As shown in FIG. 1, FIG. 2 and FIG. 5, the piston 31 is located at the third position relative to the cylinder liner 2; correspondingly, as shown in FIG. 3 and FIG. 4, the piston 31 is located at the fourth position relative to the cylinder liner 2.

As shown in FIGS. 1-5, a first oil chamber 41 and a second oil chamber 42 are defined by the cylinder 1, the cylinder liner 2 and the piston 31 and located at two sides of the piston 31 respectively, i.e. the first oil chamber 41 is located at a left side of the piston 31 as shown in the drawings, the second oil chamber 42 is located at a right side of the piston 31 as shown in the drawings. It can be understood that due to the motion of the piston 31 relative to the cylinder liner 2, volumes of the first and second oil chambers 41, 42 are variable. For example, the volume of the first oil chamber 41 is increased and the volume of the second oil chamber 42 is reduced gradually during the motion of the piston 31 from the third position to the fourth position. Similarly, the volume of the first oil chamber 41 is reduced and the volume of the second oil chamber 42 is increased gradually during the motion of the piston 31 from the fourth position to the third position.

The first oil chamber 41 is communicated with the first oil port 21, and the second oil chamber 42 is communicated with the second oil port 22. In other words, the first oil chamber 41 can be always communicated with the first oil port 21, and the second oil chamber 42 can be always communicated with the second oil port 22 regardless of the motion of the piston 31 relative to the cylinder liner 2 and the motion of the cylinder liner 2 relative to the cylinder 1.

A piston rod 32 is connected to at least one of two end faces of the piston 31 and has a free end extending out of the cylinder 1. For example, as shown in FIG. 1 to FIG. 5, two piston rods 32 are connected to the two end faces of the piston 31 respectively. The piston 31 and the piston rod 32 may be formed integrally or may be separate components. The piston 31 and the piston rod 32 may be connected together by different connection means, such as bolts, if the piston 31 and the piston rod 32 are separate components.

As shown in FIG. 2, when the cylinder liner 2 is located at the first position, a communication between the first oil inlet 151 and the first oil port 21 is formed, i.e. the first oil inlet 151 is communicated with the first oil port 21, a communication between the second oil inlet 152 and the second oil port 22 is interrupted, i.e. the second oil inlet 152 is not communicated with the second oil port 22, a communication between the first oil chamber 41 and the first oil outlet 153 is interrupted, and a communication between the second oil chamber 42 and the second oil outlet 154 is formed.

Meanwhile, an oil pump 200 supplies the first and second oil inlets 151, 152 with hydraulic oil continuously, the hydraulic oil flows into the first oil chamber 41 via the first oil inlet 151 and the first oil port 21 in turn, since the second oil inlet 152 is not communicated with the second oil port 22. Because an oil pressure inside the first oil chamber 41 is increased and the first oil chamber 41 is not communicated with the first oil outlet 153, the piston 31 is driven to move from the third position to the fourth position. During this motion of the piston 31, the second oil chamber 42 is compressed, so that the hydraulic oil within the second oil chamber 42 flows back to a hydraulic oil tank via the second oil outlet 154.

As shown in FIG. 3, when the piston 31 is moved to the fourth position, a right end of the piston 31 is against a right end of the cylinder liner 2, so that the cylinder liner 2 is driven to move from the first position to the second position by the motion of the piston 31.

As shown in FIG. 4, when the cylinder liner 2 is located at the second position, the communication between the first oil inlet 151 and the first oil port 21 is interrupted, the communication between the second oil inlet 152 and the second oil port 22 is formed, the communication between the first oil chamber 41 and the first oil outlet 153 is formed, and the communication between the second oil chamber 42 and the second oil outlet 154 is interrupted.

Meanwhile, the oil pump 200 supplies the first and second oil inlets 151, 152 with hydraulic oil continuously, the hydraulic oil flows into the second oil chamber 42 via the second oil inlet 152 and the second oil port 22 in turn, since the first oil inlet 151 is not communicated with the first oil port 21. Because an oil pressure inside the second oil chamber 42 is increased and the second oil chamber 42 is not communicated with the second oil outlet 154, the piston 31 is driven to move from the fourth position to the third position. During this motion of the piston 31, the first oil chamber 41 is compressed, so that the hydraulic oil within the first oil chamber 41 flows back to a hydraulic oil tank via the first oil outlet 153.

As shown in FIG. 5, when the piston 31 is moved to the third position, a left end of the piston 31 is against a left end of the cylinder liner 2, so that the cylinder liner 2 is driven to move from the second position to the first position by the motion of the piston 31.

With the continuous supply of hydraulic oil to the first and second oil inlets 151, 152 by the oil pump 200, the piston 31 can be moved in a manner of the straight line reciprocating motion, and thus the moving parts can be moved in the manner of the straight line reciprocating motion along with the motion of the piston 31 when the free ends of the piston rods 32 are connected to the moving parts.

As shown in FIG. 2 and FIG. 3, it can be understood that during the motion of the cylinder liner 2 from the first position to the second position, a coincidence degree between the first oil inlet 151 and the first oil port 21, i.e. an overlap ratio between the first oil inlet 151 and the first oil port 21 in an upper-lower direction as shown in FIGS. 1-5 (i.e. a radial direction of the cylinder 1), is reduced gradually. When the cylinder liner 2 arrives at the second position, the communication between the first oil inlet 151 and the first oil port 21 is fully interrupted. In other words, during the above described motion, the state of the first oil inlet 151 and the first oil port 21 is transited from communication to interruption gradually.

Contrarily, during the above described motion, the state of the second oil inlet 152 and the second oil port 22 is transited from interruption to communication gradually. Thus, during the motion of the cylinder liner 2 from the first position to the second position, the first oil inlet 151 is communicated with the first oil port 21, and the second oil inlet 152 is communicated with the second oil port 22, i.e. the hydraulic oil can be fed into the cylinder liner 2 via both of the first and second oil inlets 151 and 152. However, the piston 31 can still drive the cylinder liner 2 to move from the first position to the second position due to moving inertia of the piston 31 and the cylinder liner 2.

Therefore, during the above described motion, a resistance force is generated to reduce a moving speed of the cylinder liner 2 and buffer an impact between the cylinder liner 2 and the cylinder 1 due to formations of both communications between the first oil inlet 151 and the first oil port 21 and between the second oil inlet 152 and the second oil port 22. Thus, a rigid impact between the cylinder liner 2 and the cylinder 1 can be avoided, a service life of the hydraulic cylinder assembly 100 can be increased, and a working noise of the hydraulic cylinder assembly 100 can be reduced.

Similarly, as shown in FIG. 4 and FIG. 5, when the piston 31 arrives at the third position and drives the cylinder liner 2 to move from the second position to the first position, a resistance force is also generated to reduce the moving speed of the cylinder liner 2 and buffer an impact between the cylinder liner 2 and the cylinder 1 due to formations of both communications between the first oil inlet 151 and the first oil port 21 and between the second oil inlet 152 and the second oil port 22. Thus, a rigid impact between the cylinder liner 2 and the cylinder 1 can be avoided.

It can be understood that, the interruption between a certain inlet and a certain port means that the inlet and the port may be staggered in the relative motion between the cylinder 1 and cylinder liner 2, so that the inlet is not communicated with the port temporarily. For example, the interruption between the second oil inlet 152 and the second oil port 22 means that the communication of the second oil inlet 152 and the second oil port 22 is interrupted temporarily, so that the hydraulic oil cannot be fed to the second oil port 22 via the second oil inlet 152.

With the hydraulic cylinder assembly 100 according to an embodiment of the present disclosure, since the piston rod 32 is connected to a moving part to drive the moving part to move in a manner of the straight line reciprocating motion, when the hydraulic cylinder assembly 100 changes the moving direction of the moving part, an inertial impact of the cylinder liner 2 against the cylinder 1 can be reduced greatly, thus prolonging the service life of the hydraulic cylinder assembly 100 and reducing the working noise of the hydraulic cylinder assembly 100.

In some embodiments, a sliding resistance between the piston 31 and the cylinder liner 2 is less than that between the cylinder liner 2 and the cylinder 1. Thus, after supplying the hydraulic cylinder assembly 100 with the hydraulic oil by the oil pump 200, the motion of the piston 31 is prior to that of the cylinder liner 2, i.e. the piston 31 is moved firstly and arrives at a certain position, such as the third or fourth position, then the piston 31 drives the cylinder liner 2 to move.

In some embodiments, a first oil groove 23 and a second oil groove 24 are formed in the cylinder liner 2, the first oil groove 23 is communicated with the first oil port 21 and the first oil chamber 41 respectively, and the second oil groove 24 is communicated with the second oil port 22 and the second oil chamber 42 respectively. With the first and second oil grooves 23, 24, hydraulic oil may flow into the first oil chamber 41 via the first oil port 21 and into the second oil chamber 42 via the second oil port 22 easily.

In some embodiments, a liner groove is formed in an outer peripheral surface of the cylinder liner 2. The hydraulic cylinder assembly 100 further includes a first seal ring 51 which is configured to be fitted into the liner groove, so that a seal between the outer peripheral surface of the cylinder liner 2 and an inner peripheral surface of the cylinder 1 is formed by the first seal ring 51 to prevent the hydraulic oil from flowing.

In order to further improve the seal effect, a plurality of the liner grooves are provided and spaced apart from one another in a length direction of the cylinder liner 2 (i.e. a left-right direction as shown in FIGS. 1-5), a plurality of the first seal rings 51 are also provided and fitted into the liner grooves in a manner of one-to-one correspondence. Thus, a plurality of seals are formed between the outer peripheral surface of the cylinder liner 2 and the inner peripheral surface of the cylinder 1, so that the seal effect can be improved greatly.

Preferably, the liner groove may be configured as a ring groove and formed integrally with the outer peripheral surface of the cylinder liner 2. The first seal ring 51 may be made of rubber, but not limited to this.

In some embodiments, a piston groove is formed in an outer peripheral surface of the piston 31. The hydraulic cylinder assembly 100 may further include a second seal ring 52 which is configured to be fitted into the piston groove, so that a seal between the outer peripheral surface of the piston 31 and an inner peripheral surface of the cylinder liner 2 is formed by the second seal ring 52 to prevent the hydraulic oil from flowing between the first oil chamber 41 and the second oil chamber 42.

In order to further improve the seal effect, a plurality of the piston grooves are provided and spaced apart from one another in the length direction of the cylinder liner 2, a plurality of the second seal rings 52 are also provided and fitted into the piston grooves in a manner of one-to-one correspondence. Thus, a plurality of seals are formed between the outer peripheral surface of the piston 31 and the inner peripheral surface of the cylinder liner 2, so that the seal effect can be improved greatly.

Preferably, the piston groove may be configured as a ring groove and formed integrally with the outer peripheral surface of the piston 31. The second seal ring 52 may be made of rubber, but not limited to this.

In some embodiments, as shown in FIG. 1, the cylinder 1 includes a cylinder body 15, a first guide member 11, a second guide member 12, a first end cover 13 and a second end cover 14.

Specifically, the first and second end covers 13, 14 are disposed at two ends of the cylinder body 15 respectively, the free end of each piston rod 32 extends out of the cylinder 1 through a corresponding one of the first and second guide members 13, 14. In other words, as shown in FIG. 1, a free end of a left piston rod 32 is extended leftwards and penetrates the first guide member 11, the first guide member 11 guides a motion direction of the left piston rod 32 merely to ensure a straight line reciprocating motion in the axial direction of the left piston rod 32. On the other hand, a free end of a right piston rod 32 is extended rightwards and penetrates the second guide member 12, the second guide member 12 guides a motion direction of the right piston rod 32 merely to ensure a straight line reciprocating motion along the axial direction of the right piston rod 32.

The first end cover 13 and the second end cover 14 are disposed at the two ends of the cylinder body 15 and cover the first and second guide members 11 and 12 respectively. Specifically, the first end cover 13 may be disposed a left end of the cylinder body 15 and covers the first guide member 11, and the second end cover 14 may be disposed a right end of the cylinder body 15 and covers the second guide member 12. Thus, dust and impurities are prevented from entering into the cylinder 1 via the first and second guide members 11 and 12.

A cover groove is formed in each of the first and second end covers 13 and 14, and the hydraulic cylinder assembly 100 further includes a third seal ring 53 which is disposed in the cover groove and fitted over an outer peripheral surface of each piston rod 32. Thus, dust and impurities are prevented from entering into the cylinder 1 via a gap between the piston rod 32 and the end covers 31 and 32, such that a dustproof performance of the hydraulic cylinder assembly 100 can be further improved.

Preferably, each of the end covers 13 and 14 may have a plurality of the cover grooves, and a plurality of the third seal rings 53 are also provided to form a plurality of seals with the cover grooves. Thus, the dustproof performance of the hydraulic cylinder assembly 100 can be further improved. The third seal ring 53 may be made of rubber, but not limited to this.

A hydraulic device according to embodiments of the present disclosure will be described with reference to the drawings and embodiments.

As shown in FIG. 2 to FIG. 5, the hydraulic device according to embodiments of the present disclosure includes a hydraulic cylinder assembly 100 and an oil pump 200. The hydraulic cylinder assembly 100 is described in the above mentioned embodiments. The oil pump 200 is communicated with the first oil inlet 151 and the second oil inlet 152 to supply hydraulic oil to the first and second oil inlets 151 and 152 respectively.

Preferably, only one oil pump 200 is provided, but not limited to this, so that the hydraulic device according to embodiments of the present disclosure has a simple structure.

In some embodiments, the oil pump 200 may include a first sub-oil pump and a second sub-oil pump (not shown), the first sub-oil pump is communicated with the first oil inlet 151 to supply hydraulic oil to the first oil inlet 151 and the second sub-oil pump is communicated with the second oil inlet 152 to supply hydraulic oil to the second oil inlet 152.

A forklift according to embodiments of the present disclosure will be described with reference to the drawings and embodiments.

The forklift according to embodiments of the present disclosure includes a hydraulic device which is described in the above mentioned embodiments. It can be understood that the other structures and working principle of the forklift according to embodiments of the present disclosure are known to those skilled in the related art, so that the relative descriptions will be omitted herein.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A hydraulic cylinder assembly, comprising:

a cylinder defining a first oil inlet, a second oil inlet, a first oil outlet and a second oil outlet therein;

a cylinder liner disposed within the cylinder and being moveable between a first position and a second position, and defining a first oil port and a second oil port therein;

a piston disposed within the cylinder liner and being moveable between a third position and a fourth position; and a first piston rod connected to one of two end faces of the piston and defining a free end extending out of the cylinder, wherein a first oil chamber and a second oil chamber are defined by the cylinder, the cylinder liner and the piston and located at two sides of the piston respectively, the first oil chamber is communicated with the first oil port, and the second oil chamber is communicated with the second oil port, wherein when the cylinder liner is located at the first position, a communication between the first oil inlet and the first oil port is formed, a communication between the second oil inlet and the second oil port is interrupted, a communication between the first oil chamber and the first oil outlet is interrupted, and a communication between the second oil chamber and the second oil outlet is formed, wherein when the cylinder liner is located at the second position, the communication between the first oil inlet and the first oil port is interrupted, the communication between the second oil inlet and the second oil port is formed, the communication between the first oil chamber and the first oil outlet is formed, and the communication between the second oil chamber and the second oil outlet is interrupted; and wherein a first oil groove and a second oil groove are formed in the cylinder liner, the first oil groove is communicated with the first oil port and the first oil chamber respectively, and the second oil groove is communicated with the second oil port and the second oil chamber respectively.

2. The hydraulic cylinder assembly of claim 1, wherein a sliding resistance between the piston and the cylinder liner is less than that between the cylinder liner and the cylinder.

3. The hydraulic cylinder assembly of claim 1, further comprising a first seal ring, wherein a liner groove is formed in an outer peripheral surface of the cylinder liner and configured to receive the first seal ring therein.

4. The hydraulic cylinder assembly of claim 3, wherein a plurality of the liner grooves are provided and spaced apart from one another in a length direction of the cylinder liner, a plurality of the first seal rings are provided and fitted into the liner grooves in a manner of one-to-one correspondence.

5. The hydraulic cylinder assembly of claim 1, further comprising a second seal ring, wherein a piston groove is formed in an outer peripheral surface of the piston and configured to receive the second seal ring therein.

6. The hydraulic cylinder assembly of claim 1, wherein a second piston rod is connected to the other one of the two end faces of the piston, wherein the cylinder further comprises:

a cylinder body;

a first guide member and a second guide member disposed at two ends of the cylinder body respectively, wherein the free end of each piston rod extends out of the cylinder through a corresponding one of the first and second guide members.

7. The hydraulic cylinder assembly of claim 6, wherein the cylinder further comprises a first end cover and a second end cover disposed at the two ends of the cylinder body and covering the first and second guide members respectively.

8. The hydraulic cylinder assembly of claim 7, further comprising a third seal ring, wherein a cover groove is formed in each of the first and second end covers, wherein the third seal ring is disposed in one of the cover grooves and fitted over an outer peripheral surface of one of the piston rods.

9. A hydraulic device, comprising:

a hydraulic cylinder assembly, the hydraulic cylinder assembly further comprising:

a cylinder defining a first oil inlet, a second oil inlet, a first oil outlet and a second oil outlet therein;

a cylinder liner disposed within the cylinder and being moveable between a first position and a second position, and defining a first oil port and a second oil port therein;

a piston disposed within the cylinder liner and being moveable between a third position and a fourth position; and a piston rod connected to one of two end faces of the piston and defining a free end extending out of the cylinder, wherein a first oil chamber and a second oil chamber are defined by the cylinder, the cylinder liner and the piston and located at two sides of the piston respectively, the first oil chamber is communicated with the first oil port, and the second oil chamber is communicated with the second oil port, wherein when the cylinder liner is located at the first position, a communication between the first oil inlet and the first oil port is formed, a communication between the second oil inlet and the second oil port is interrupted, a communication between the first oil chamber and the first oil outlet is interrupted, and a communication between the second oil chamber and the second oil outlet is formed, wherein when the cylinder liner is located at the second position, the communication between the first oil inlet and the first oil port is interrupted, the communication between the second oil inlet and the second oil port is formed, the communication between the first oil chamber and the first oil outlet is formed, and the communication between the second oil chamber and the second oil outlet is interrupted, and wherein a first oil groove and a second oil groove are formed in the cylinder liner, the first oil groove is communicated with the first oil port and the first oil chamber respectively, and the second oil groove is communicated with the second oil port and the second oil chamber respectively; and an oil pump connected to the first oil inlet and the second oil inlet to supply hydraulic oil to the first and second oil inlets respectively.

* * * * *